US010653973B2

(12) United States Patent
Huang et al.

(10) Patent No.: US 10,653,973 B2
(45) Date of Patent: May 19, 2020

(54) ELECTRONIC BUILDING-BLOCK MODULE

(71) Applicant: ROBO ELECTRONICS CO., LTD, Zhongshan, Guangdong (CN)

(72) Inventors: Xuanguang Huang, Guangdong (CN); Xuewen Ma, Guangdong (CN)

(73) Assignee: ROBO ELECTRONICS CO., LTD, Zhongshan, Guangdong (CN)

( * ) Notice: Subject to any disclaimer, the term of this patent is extended or adjusted under 35 U.S.C. 154(b) by 0 days.

(21) Appl. No.: 16/307,481

(22) PCT Filed: Feb. 28, 2017

(86) PCT No.: PCT/CN2017/075234
§ 371 (c)(1),
(2) Date: Dec. 6, 2018

(87) PCT Pub. No.: WO2017/197952
PCT Pub. Date: Nov. 23, 2017

(65) Prior Publication Data

US 2019/0192985 A1 Jun. 27, 2019

(30) Foreign Application Priority Data

May 20, 2016 (CN) ..... 2016 1 0345703

(51) Int. Cl.
*A63H 33/08* (2006.01)
*A63H 33/04* (2006.01)
*A63H 33/26* (2006.01)
*G09B 17/00* (2006.01)

(52) U.S. Cl.
CPC ..... *A63H 33/08* (2013.01); *A63H 33/042* (2013.01); *A63H 33/26* (2013.01)

(58) Field of Classification Search
CPC ..... A63H 33/00; A63H 33/04; A63H 33/08; A63H 33/042; A63H 33/086; G09B 17/003; G09B 15/023; G09B 23/185
USPC ..... 446/85, 91, 484
See application file for complete search history.

(56) References Cited

U.S. PATENT DOCUMENTS 8,651,913 B1 * 2/2014 Lin ..... A63H 33/042 446/91
2011/0263177 A1 * 10/2011 Lemchen ..... A63H 33/04 446/87
2015/0072585 A1 * 3/2015 Lin ..... A63H 33/042 446/91

FOREIGN PATENT DOCUMENTS

CN 102114352 * 6/2011

* cited by examiner

*Primary Examiner* — Kien T Nguyen

(57) ABSTRACT

An electronic building-block module includes a main body, multiple projections spacedly arranged on a top surface of the main body, a circuit board, multiple main connectors and multiple sub connectors; the electronic building-block module has multiple recesses which are provided at a bottom portion of the main body for respectively accommodating the multiple projections; the main body has a cavity therein, the circuit board is located within the cavity; each of the multiple projections has a cylindrical shape with an upper opening, the multiple main connectors are respectively located within the upper opening of the multiple projections; the multiple sub connectors are respectively located within a lower opening of the multiple recesses; the multiple main connectors of one electronic building-block module are respectively in nested connection with the multiple sub connectors of another electronic building-block module.

12 Claims, 5 Drawing Sheets

ELECTRONIC BUILDING-BLOCK MODULE

CROSS REFERENCE OF RELATED APPLICATION

This is a U.S. National Stage under 35 U.S.C 371 of the International Application PCT/CN2017/075234, filed Feb. 28, 2017, which claims priority under 35 U.S.C. 119(a-d) to CN 201610345703.7, filed May 20, 2016.

BACKGROUND OF THE PRESENT INVENTION

Field of Invention

The present invention relates to the technical field of educational toys and educational robots, and more particularly to a building-block with electronic devices.

Description of Related Art

LEGO Corporation is a world-famous toy manufacturer. Assembled toys invented by LEGO can develop children's intelligence and exercise children's hands-on ability. The sales of LEGO's building-block toys are among the top ten toys in the world. Currently, there are a lot of assembled toys in the LEGO style on the market. Most of these toys are built on different themes by stacking building-blocks of different sizes.

Traditional assembled building-block toys lack the interactive function with the user, which reduces the fun, so that the children slowly do not like to play. With the development of microelectronics technology, some large toy manufacturers in China have introduced modular electronic robot kits, but these robots are designed by basically connecting various modules with built-in electronic devices with each other through connecting wires, so that the connection mode based on external connecting wires necessitates a good joint and a matching interface. When an amount of wires and interfaces is large, it is easy to cause confusion to the user, which is not conducive to the construction of the model. Moreover, the misoperation of the children may damage the interface, so that the functional module and the main control terminal are in poor contact.

Moreover, foreign toy manufacturers use the magnet to combine two sensors together, and metal elastic pieces on the two sensors contact with each other to form the connectivity for further producing interaction. The above manner has some drawbacks as follows. The magnetic connection manner is just horizontally expanded, so that modules are unable to be spliced together through a conventional building-block stacking method, thus a three-dimensional model is unable to be built. Furthermore, the magnetic connection manner easily leads to separation, so that the functions of electric devices are unable to be achieved due to broken lines. Obviously, it can be seen that the circuit design based on the magnetic connection manner is not flexible enough in the combination mode. Therefore, it is necessary to provide a new electronic building-block module which is simple in structure, convenient to be spliced, and can electrically connected with other electronic building-block modules. Moreover, based on the new electronic building-block module, a variety of models can be built by a stacking mode, the built models can interact with users, and the new electronic building-block module can be used in combination with conventional LEGO building-block toys.

SUMMARY OF THE PRESENT INVENTION

An object of the present invention is to provide an electronic building-block module for solving the above problems, which adopts the way of stacking and splicing building-blocks to assemble the electronic building-block modules, which is more convenient and stable; and at the same time, electronic devices built in the electronic building-block module are connected and communicated with each other by means of a bus, and a variety of intelligent robot models can be built, which has high flexibility, realizes human-machine interaction, and can also be used in combination with the existing LEGO toy building-blocks.

The present invention is achieved as follows. An electronic building-block module comprises a main body, multiple projections spacedly arranged on a top surface of the main body, a circuit board, multiple main connectors and multiple sub connectors, wherein:

the electronic building-block module has multiple recesses which are provided at a bottom portion of the main body for respectively accommodating the multiple projections;

the main body has a cavity therein, the circuit board is located within the cavity;

each of the multiple projections has a cylindrical shape with an upper opening, the multiple main connectors are respectively located within the upper opening of the multiple projections, each of the multiple main connectors has at least three conductive contact points which are respectively electrically connected with a signal terminal, a power terminal and a ground terminal of the circuit board;

the multiple sub connectors are respectively located within a lower opening of the multiple recesses, each of the multiple sub connectors has at least another three conductive contact points which are respectively electrically connected with the signal terminal, the power terminal and the ground terminal of the circuit board within the cavity of the main body;

the multiple main connectors are in nested connection with the multiple sub connectors, respectively.

Preferably, each of the multiple main connectors is cylindrical and comprises a first conductive lantern ring, a second conductive lantern ring and a contact pin, wherein the first conductive lantern ring is connected with the ground terminal of the circuit board, the second conductive lantern ring is connected with the signal terminal of the circuit board, and the contact pin is connected with the power terminal of the circuit board;

each of the multiple sub connectors is cylindrical and comprises a third conductive lantern ring, a fourth conductive lantern ring and a contact tube, wherein the third conductive lantern ring is connected with the ground terminal of the circuit board, the fourth conductive lantern ring is connected with the signal terminal of the circuit board, and the contact tube is connected with the power terminal of the circuit board;

while splicing two electronic building-block modules, the projections of a first electronic building-block module are respectively in alignment with the recesses of a second electronic building-block module; and correspondingly, the sub connectors within the recesses of the second electronic building-block module are respectively inserted into the main connectors within the projections of the first electronic building-block module; the contact pin of each of the main connectors of the first electronic building-block module is inserted into the contact tube of each of the sub connectors of the second electronic building-block module for electrically connecting with each other; the first conductive lantern ring of each of the main connectors of the first electronic building-block module contacts with the third conductive lantern ring of each of the sub connectors of the second electronic building-block module for electrically connecting with each other; the second conductive lantern ring of each of the main connectors of the first electronic building-block module contacts with the fourth conductive lantern ring of each of the sub connectors of the second electronic building-block module for electrically connecting with each other, so that the two electronic building-block modules are connected with each other to achieve three-line one-to-one conduction.

Preferably, the circuit board comprises a first sub circuit board and a second sub circuit board, wherein the multiple main connectors are welded on an upper surface of the first sub circuit board, the multiple sub connectors are welded on a lower surface of the second sub circuit board, the first sub circuit board and the second sub circuit board are respectively fixed on a skeleton, the first sub circuit board is electrically connected with the second sub circuit board.

Preferably, each of the main connectors is cylindrical and comprises a first conductive lantern ring and a second conductive lantern ring, wherein a first conductive layer is provided on an internal surface of the first conductive lantern ring, a second conductive layer is provided on an external surface of the second conductive lantern ring, and a first conductive elastic piece is longitudinally set at an internal surface of the second conductive lantern ring;

each of the sub connectors is cylindrical and comprises a third conductive lantern ring and a conductive column, wherein a second conductive elastic piece is longitudinally set at an internal surface of the third conductive lantern ring, and a third conductive elastic piece is longitudinally set at an external surface of the third conductive lantern ring;

the main connectors are in nested electrical connection with the sub connectors, respectively, the conductive column of each of the sub connectors contacts with the second conductive lantern ring of each of the main connectors through the first conductive elastic piece for electrically connecting with each other, the second conductive elastic piece at the internal surface of the third conductive lantern ring of each of the sub connectors contacts with the second conductive layer provided on the external surface of the second conductive lantern ring for electrically connecting with each other; the third conductive elastic piece at the external surface of the third conductive lantern ring of each of the sub connectors contacts with the first conductive layer provided on the internal surface of the first conductive lantern ring for electrically connecting with each other, so that two electronic building-block modules are connected with each other to achieve three-line one-to-one conduction.

Preferably, each of the main connectors and a corresponding sub connector are coaxially aligned with each other.

The electronic building-block modules, provided by the present invention, are assembled and spliced based on the structures mentioned above, which is more convenient and stable; and at the same time, electronic devices built in the electronic building-block module are connected and communicated with each other by means of a bus, and a variety of intelligent robot models can be built, which has high flexibility, realizes human-machine interaction, and can also be used in combination with the existing LEGO toy building-blocks, thus greatly enhancing the entertainment and interest of building-block toys.

DETAILED DESCRIPTION OF THE PREFERRED EMBODIMENT

Figure 1:
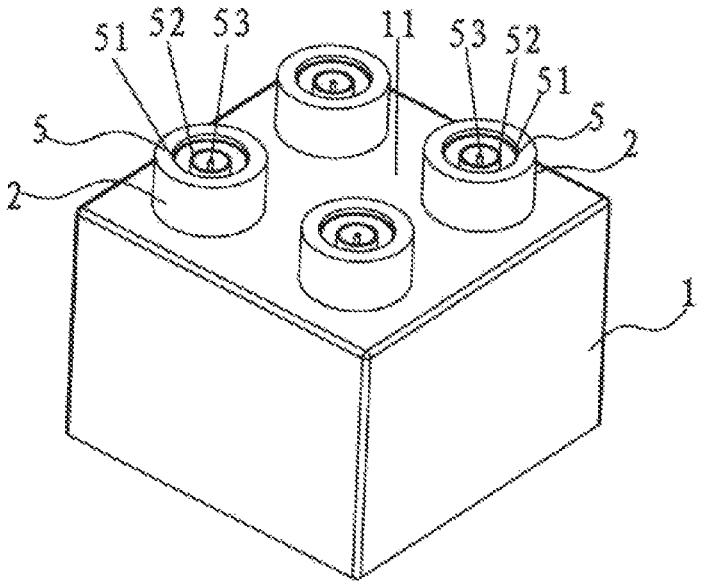
FIG. 1 is a stereogram of an electronic building-block module according to a first preferred embodiment of the present invention.
Figure 2:
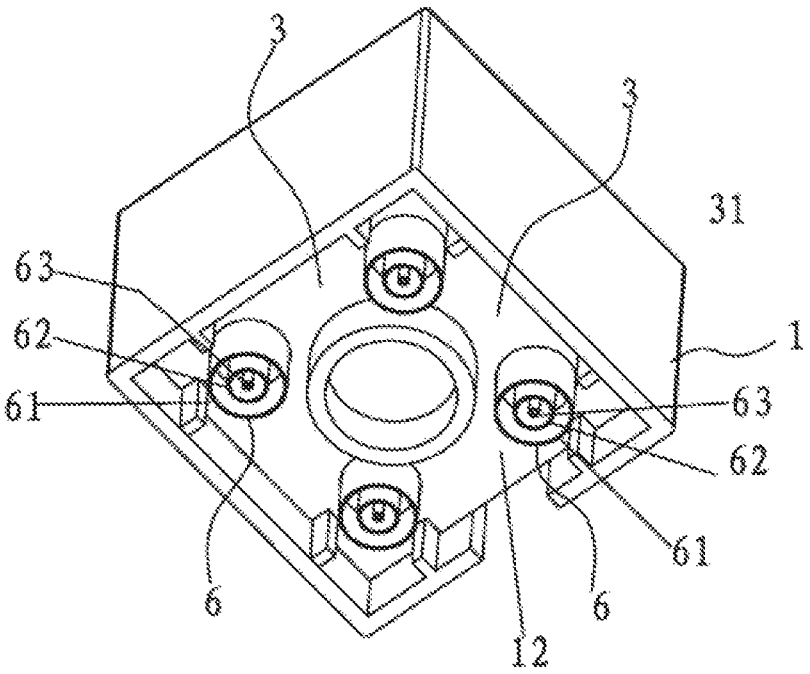
FIG. 2 is another stereogram of the electronic building-block module according to the first preferred embodiment of the present invention.
Figure 3:
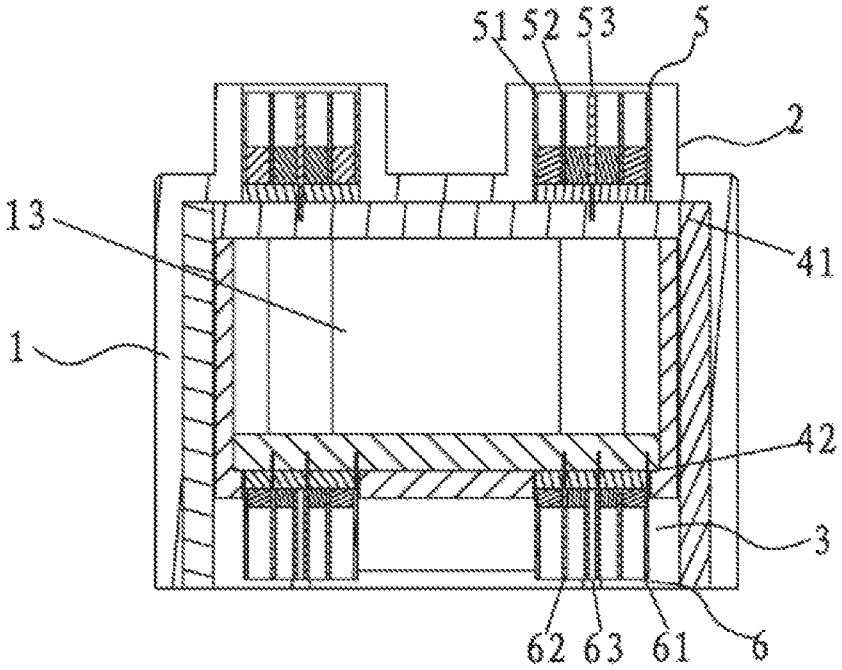
FIG. 3 is a sectional view of the electronic building-block module according to the first preferred embodiment of the present invention.
Figure 4:
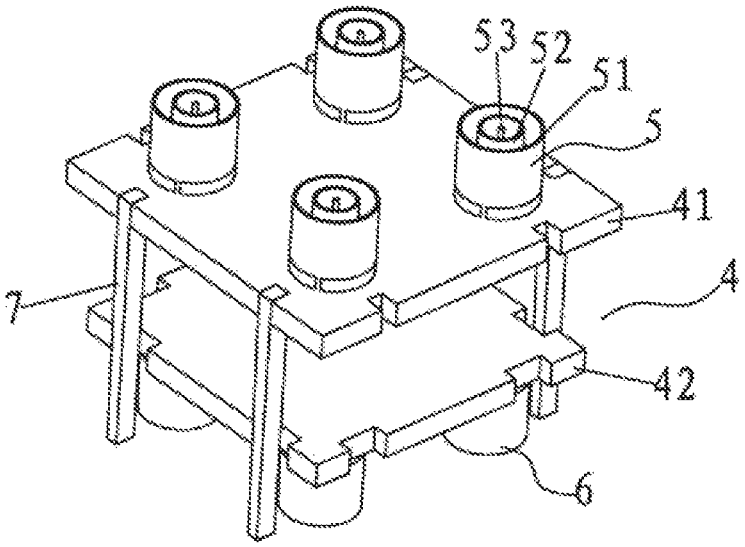
FIG. 4 is another stereogram of the electronic building-block module after being removed a housing according to the first preferred embodiment of the present invention.

An electronic building-block module provided by the present invention is further explained with accompanying drawings in detail as follows. The drawings of the electronic building-block module provided by the present invention only schematically indicate the relative positional relationship of the components, and do not represent the actual shape thereof.

First Embodiment

Referring to FIGS. 1-4, an electronic building-block module according to a first preferred embodiment of the present invention is illustrated, which comprises a main body 1, multiple projections 2 are spacedly arranged on a top surface 11 of the main body 1, and a circuit board 4; the electronic building-block module has multiple recesses 3 which are provided at a bottom portion 12 of the main body 1 for respectively accommodating the multiple projections 2; the main body 1 has a cavity 13 therein; the circuit board 4 is located within the cavity 13; every projection 2 has a cylindrical shape with an upper opening.

The electronic building-block module further comprises multiple main connectors 5 and multiple sub connectors 6, wherein each of the multiple main connectors 5 is correspondingly located within the upper opening of each of the multiple projections 2; each of the multiple main connectors 5 has at least three metal contact points which are respectively electrically connected with a signal terminal, a power terminal and a ground terminal of the circuit board 4 located within the cavity 13 of the main body 1.

The multiple sub connectors 6 are respectively located within the recesses 3, each of the multiple sub connectors 6 has at least another three metal contact points which are respectively electrically connected with the signal terminal, the power terminal and the ground terminal of the circuit board 4 located within the cavity 13 of the main body 1.

Each of the multiple main connectors 5 is cylindrical and comprises a first conductive lantern ring 51, a second conductive lantern ring 52 and a contact pin 53, wherein the first conductive lantern ring 51 is connected with the ground terminal, the second conductive lantern ring 52 is connected with the signal terminal, and the contact pin 53 is connected with the power terminal via the at least three metal contact points of each of the multiple main connectors 5, respectively.

Each of the multiple sub connectors 6 is cylindrical and comprises a third conductive lantern ring 61, a fourth conductive lantern ring 62 and a contact tube 63, wherein the third conductive lantern ring 61 is connected with the ground terminal, the fourth conductive lantern ring 62 is connected with the signal terminal, and the contact tube 63 is connected with the power terminal via the at least another three metal contact points of each of the multiple sub connectors 6.

The circuit board 4 comprises a first sub circuit board 41 and a second sub circuit board 42, wherein the multiple main connectors 5 are welded on an upper surface of the first sub circuit board 41, the multiple sub connectors 6 are welded on a lower surface of the second sub circuit board 42; the first sub circuit board and the second sub circuit board are respectively fixed on a skeleton 7; the first sub circuit board is electrically connected with the second sub circuit board.

Furthermore, the circuit board further comprises a main control sub circuit board, wherein a microprocessor, a memory, a programmable controller, an analog conversion device, an input interface and an output interface are disposed on the main control sub circuit board to execute a set procedure for achieving a corresponding function; the main control sub circuit board is electrically connected with both the first sub circuit board 41 and the second sub circuit board 42.

Each of the main connectors and a corresponding sub connector are coaxially aligned with each other, and the main connectors of one electronic building-block module are respectively in nested connection with the sub connectors of another electronic building-block module.

Figure 5:
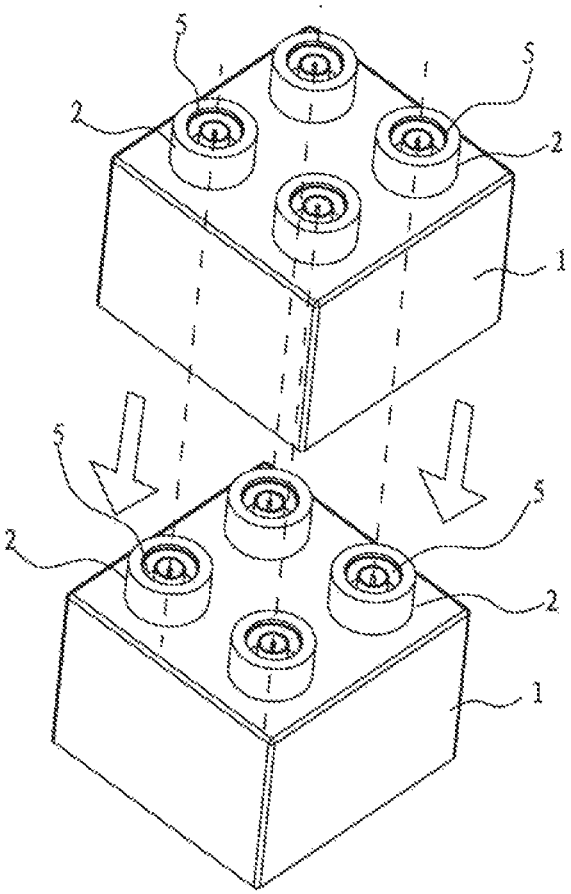
FIG. 5 shows that two electronic building-block modules according to the first preferred embodiment of the present invention are spliced together.
Figure 6:
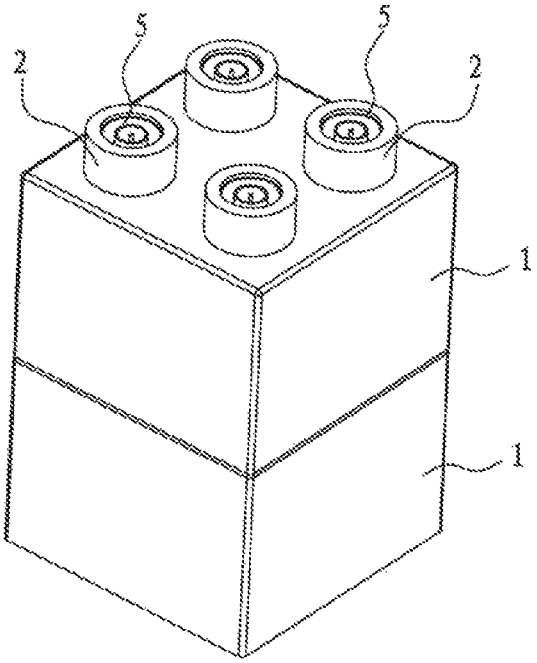
FIG. 6 shows two spliced electronic building-block modules according to the first preferred embodiment of the present invention.
Figure 7:
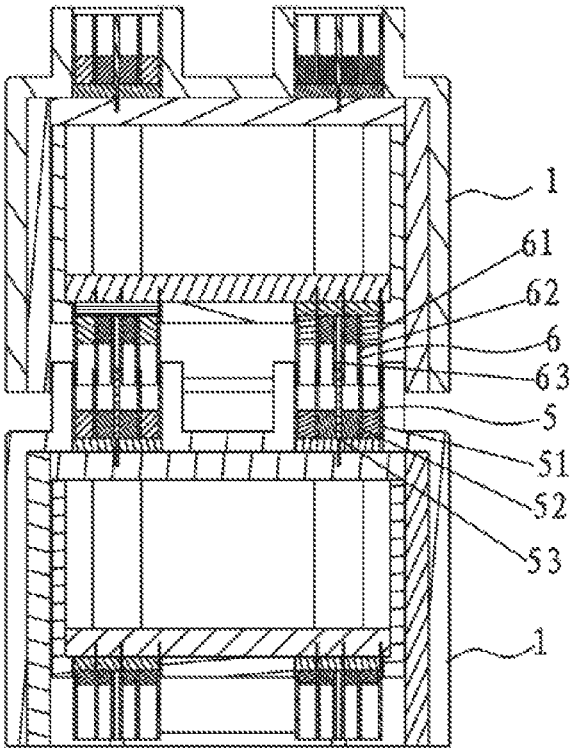
FIG. 7 is a sectional view of two spliced electronic building-block modules according to the first preferred embodiment of the present invention.
Figure 8:
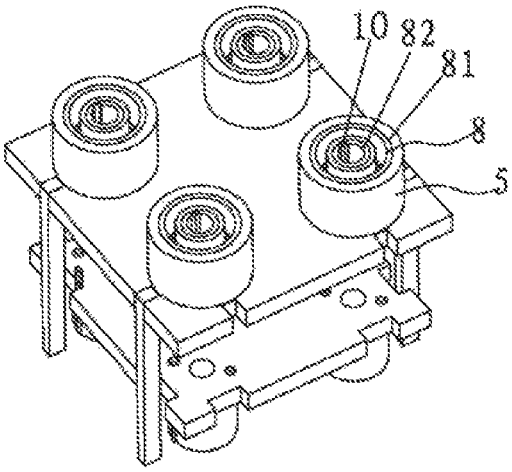
FIG. 8 is a stereogram of an electronic building-block module after being removed a housing according to a second preferred embodiment of the present invention.
Figure 9:
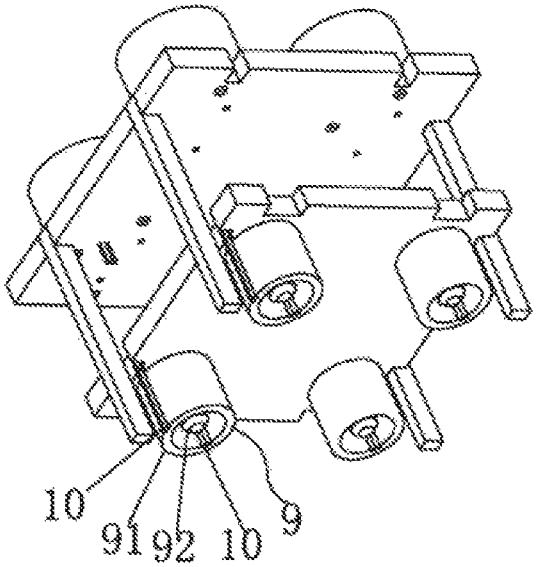
FIG. 9 is another stereogram of the electronic building-block module after being removed the housing according to the second preferred embodiment of the present invention.

As shown in FIGS. 5, 6 and 7, while splicing two electronic building-block modules, the projections 2 of a first electronic building-block module are respectively in alignment with the recesses 3 of a second electronic building-block module which is opposite to the first electronic building-block module; and correspondingly, the main connectors 5 of the first electronic building-block module are respectively in nested connection with the sub connectors 6 of the second electronic building-block module; the contact pin 53 of each of the main connectors 5 of the first electronic building-block module is inserted into the contact tube 63 of each of the sub connectors 6 of the second electronic building-block module for electrically connecting with each other; the first conductive lantern ring 51 of each of the main connectors 5 of the first electronic building-block module contacts with the third conductive lantern ring 61 of each of the sub connectors 6 of the second electronic building-block module for electrically connecting with each other; the second conductive lantern ring 52 of each of the main connectors 5 of the first electronic building-block module contacts with the fourth conductive lantern ring 62 of each of the sub connectors 6 of the second electronic building-block module for electrically connecting with each other; the two electronic building-block modules are connected with each other in parallel and connected to a bus.

Second Embodiment

The present invention is further improved as follows. Every main connector 8 of an electronic building-block module according to a second preferred embodiment of the present invention is cylindrical and comprises a first lantern ring 81 and a second lantern ring 82, wherein a conductive layer is provided on an internal surface of the first lantern ring 81, another conductive layer is provided on an external surface of the second lantern ring 82, and a conductive elastic piece 10 is longitudinally set at an internal surface of the second lantern ring 82.

Every sub connector 9 is cylindrical and comprises a third lantern ring 91 and a conductive column 92, wherein another conductive elastic piece 10 is longitudinally set at an internal surface of the third lantern ring 91, and another conductive elastic piece 10 is longitudinally set at an external surface of the third lantern ring 91.

Every main connector 8 is in nested electrical connection with a corresponding sub connector 9; the conductive column 92 of the corresponding sub connector 9 contacts with the second lantern ring 82 of the main connector 8 through the conductive elastic piece 10 which is longitudinally set at the internal surface of the second lantern ring 82 for electrically connecting with each other; the conductive elastic piece 10 at the internal surface of the third lantern ring 91 of the corresponding sub connector 9 contacts with the conductive layer provided on the external surface of the second lantern ring 82 for electrically connecting with each other; the conductive elastic piece 10 at the external surface of the third lantern ring 91 of the corresponding sub connector 9 contacts with the conductive layer provided on the internal surface of the first lantern ring 81 for electrically connecting with each other, so that the main connectors 8 of one electronic building-block module and the sub connectors 9 of another electronic building-block module are respectively connected with each other to achieve three-line one-to-one conduction. All lantern rings in the second embodiment of the present invention are made from an insulation material.

The above is only a preferred embodiment of the present invention. It should be noted that, for those skilled in the art, some modifications and variations can be made without departing from the principle of the present invention, which are also considered to be the protective scope of the present invention.

What is claimed is:

1. An electronic building-block module, wherein:

the electronic building-block module comprises a main body, multiple projections spacedly arranged on a top surface of the main body, a circuit board, multiple main connectors and multiple sub connectors;

the electronic building-block module has multiple recesses which are provided at a bottom portion of the main body for respectively accommodating the multiple projections;

the main body has a cavity therein, the circuit board is located within the cavity;

each of the multiple projections has a cylindrical shape with an upper opening, the multiple main connectors are respectively located within the upper opening of the multiple projections, each of the multiple main connectors has at least three conductive contact points which are respectively electrically connected with a signal terminal, a power terminal and a ground terminal of the circuit board;

the multiple sub connectors are respectively located within a lower opening of the multiple recesses, each of the multiple sub connectors has at least another three conductive contact points which are respectively electrically connected with the signal terminal, the power terminal and the ground terminal of the circuit board within the cavity of the main body;

the multiple main connectors are in nested connection with the multiple sub connectors, respectively.

2. The electronic building-block module, as recited in claim 1, wherein:

each of the multiple main connectors is cylindrical and comprises a first conductive lantern ring, a second conductive lantern ring and a contact pin, wherein the first conductive lantern ring is connected with the ground terminal, the second conductive lantern ring is connected with the signal terminal, and the contact pin is connected with the power terminal;

each of the multiple sub connectors is cylindrical and comprises a third conductive lantern ring, a fourth conductive lantern ring and a contact tube, wherein the third conductive lantern ring is connected with the ground terminal, the fourth conductive lantern ring is connected with the signal terminal, and the contact tube is connected with the power terminal;

while splicing two electronic building-block modules, the projections of a first electronic building-block module are respectively in alignment with the recesses of a second electronic building-block module; and correspondingly, the sub connectors within the recesses of the second electronic building-block module are respectively inserted into the main connectors within the projections of the first electronic building-block module;

the contact pin of each of the main connectors of the first electronic building-block module is inserted into the contact tube of each of the sub connectors of the second electronic building-block module for electrically connecting with each other; the first conductive lantern ring of each of the main connectors of the first electronic building-block module contacts with the third conductive lantern ring of each of the sub connectors of the second electronic building-block module for electrically connecting with each other; the second conductive lantern ring of each of the main connectors of the first electronic building-block module contacts with the fourth conductive lantern ring of each of the sub connectors of the second electronic building-block module for electrically connecting with each other, so that the two electronic building-block modules are connected with each other to achieve three-line one-to-one conduction.

3. The electronic building-block module, as recited in claim wherein:

the circuit board comprises a first sub circuit board and a second sub circuit board, wherein the multiple main connectors are welded on an upper surface of the first sub circuit board, the multiple sub connectors are welded on a lower surface of the second sub circuit board, the first sub circuit board and the second sub circuit board are respectively fixed on a skeleton, the first sub circuit board is electrically connected with the second sub circuit board.

4. The electronic building-block module, as recited in claim 3, wherein: each of the main connectors and a corresponding sub connector are coaxially aligned with each other.

5. The electronic building-block module, as recited in claim 2, wherein: each of the main connectors and a corresponding sub connector are coaxially aligned with each other.

6. The electronic building-block module, as recited in claim 1, wherein:

each of the main connectors is cylindrical and comprises a first lantern ring and a second lantern ring, wherein a first conductive layer is provided on an internal surface of the first lantern ring, a second conductive layer is provided on an external surface of the second lantern ring, and a first conductive elastic piece is longitudinally set at an internal surface of the second lantern ring;

each of the sub connectors is cylindrical and comprises a third lantern ring and a conductive column, wherein a second conductive elastic piece is longitudinally set at an internal surface of the third lantern ring, and a third conductive elastic piece is longitudinally set at an external surface of the third lantern ring;

the main connectors are in nested electrical connection with the sub connectors, respectively, the conductive column of each of the sub connectors contacts with the second lantern ring of each of the main connectors through the first conductive elastic piece for electrically connecting with each other, the second conductive elastic piece at the internal surface of the third lantern ring of each of the sub connectors contacts with the second conductive layer provided on the external surface of the second lantern ring for electrically connecting with each other; the third conductive elastic piece at the external surface of the third lantern ring of each of the sub connectors contacts with the first conductive layer provided on the internal surface of the first lantern ring for electrically connecting with each other, so that two electronic building-block modules are connected with each other to achieve three-line one-to-one conduction.

7. The electronic building-block module, as recited in claim 6, wherein:

the circuit board comprises a first sub circuit board and a second sub circuit board, wherein the multiple main connectors are welded on an upper surface of the first sub circuit board, the multiple sub connectors are welded on a lower surface of the second sub circuit board, the first sub circuit board and the second sub circuit board are respectively fixed on a skeleton, the first sub circuit board is electrically connected with the second sub circuit board.

8. The electronic building-block module, as recited in claim 7, wherein: each of the main connectors and a corresponding sub connector are coaxially aligned with each other.

9. The electronic building-block module, as recited in claim 6, wherein: each of the main connectors and a corresponding sub connector are coaxially aligned with each other.

10. The electronic building-block module, as recited in claim 1, wherein:

the circuit board comprises a first sub circuit board and a second sub circuit board, wherein the multiple main connectors are welded on an upper surface of the first sub circuit board, the multiple sub connectors are welded on a lower surface of the second sub circuit board, the first sub circuit board and the second sub circuit board are respectively fixed on a skeleton, the first sub circuit board is electrically connected with the second sub circuit board.

11. The electronic building-block module, as recited in claim 10, wherein: each of the main connectors and a corresponding sub connector are coaxially aligned with each other.

12. The electronic building-block module, as recited in claim 1, wherein: each of the main connectors and a corresponding sub connector are coaxially aligned with each other.

* * * * *